US008746415B2

(12) United States Patent
Aluisetti

(10) Patent No.: US 8,746,415 B2
(45) Date of Patent: Jun. 10, 2014

(54) MAGNETIC LOCK FOR A CONTROL UNIT IN AN ELEVATOR INSTALLATION

(75) Inventor: Marco Aluisetti, Locarno (CH)

(73) Assignee: Inventio AG, Hergiswil (CH)

( * ) Notice: Subject to any disclaimer, the term of this patent is extended or adjusted under 35 U.S.C. 154(b) by 494 days.

(21) Appl. No.: 13/197,970

(22) Filed: Aug. 4, 2011

(65) Prior Publication Data

US 2012/0031708 A1 Feb. 9, 2012

(30) Foreign Application Priority Data

Aug. 4, 2010 (EP) ..... 10171892

(51) Int. Cl.
*B66B 7/00* (2006.01)

(52) U.S. Cl.
USPC ..... 187/414; 187/391

(58) Field of Classification Search
USPC ..... 187/247, 313, 316, 317, 279, 280, 336, 187/339, 391–396, 413, 414; 49/25, 26, 28; 292/251.5; 70/276
See application file for complete search history.

(56) References Cited

U.S. PATENT DOCUMENTS 4,848,812 A * 7/1989 Slaughter ..... 292/144
5,076,623 A * 12/1991 Richards ..... 292/251.5
5,485,733 A * 1/1996 Hoffman ..... 70/276
5,829,554 A * 11/1998 Benson et al. ..... 187/414
6,227,335 B1 * 5/2001 Koeppe et al. ..... 187/414
6,357,553 B1 * 3/2002 Vialonga ..... 187/385
7,237,655 B2 * 7/2007 Kocher ..... 187/314
7,318,501 B2 * 1/2008 Felder ..... 187/414
7,404,470 B2 * 7/2008 Felder et al. ..... 187/395
2006/0054421 A1 * 3/2006 Ikeda ..... 187/395
2006/0117820 A1 * 6/2006 Lanigan et al. ..... 70/279.1

FOREIGN PATENT DOCUMENTS

JP 48018251 U 3/1973
JP 48046013 U 6/1973
JP H0321078 U 3/1991

* cited by examiner

*Primary Examiner* — Anthony Salata
(74) *Attorney, Agent, or Firm* — Fraser Clemens Martin & Miller LLC; William J. Clemens

(57) ABSTRACT

A control unit for an elevator installation comprises a cover and a base. The control unit further comprises a lock which can lock the cover to the base or release it from the base. The lock comprises a locking bar with a magnet, wherein this locking bar is movable back and forth between a closed position and an open position by movement of a magnetic lock on a surface of the cover. The locking bar with the magnet is stabilized in the closed position by a first magnetic element and the cover is locked. The locking bar with the magnet is stabilized in the open position by a second magnetic element and the cover is released.

15 Claims, 3 Drawing Sheets

MAGNETIC LOCK FOR A CONTROL UNIT IN AN ELEVATOR INSTALLATION

CROSS-REFERENCE TO RELATED APPLICATION

This application claims priority to European Patent Application No. 10171892.2, filed Aug. 4, 2010, which is incorporated herein by reference.

FIELD

The present disclosure relates to a lock for a control unit in an elevator installation.

BACKGROUND

Control units are usually mounted in elevator cages and/or in front of shaft doors in elevator installations. Such control units serve for, for example, the input of a destination story by the passenger and for the indication of items of information, such as, for example, a designation of a story at which the elevator cage is currently located. In that case, the control units are usually connected with switching and safety circuits of the elevator installation by cable connections. At the time of service operations at the elevator installation it can be necessary to open a control unit in order to gain access to the interior of the control unit.

Generally, such control units are merely hooked in place or screw-connected. Control units which are hooked in place are often readily accessible to persons not intended to have access. Screw-connected control units generally are awkward to open.

However, in order to provide protection against vandalism, such control units are sometimes locked. Simple locks such as, for example, triangular locks sometimes do not offer effective protection against vandalism. Other locks are sometimes expensive on the one hand, and on the other hand are similarly exposed to vandalism. Thus, for example, the keyhole can be locked or damaged.

SUMMARY

At least some embodiments of the disclosed technologies provide a control unit with a lock which can be securely locked and can be opened in simple manner and which is convenient to produce. In at least some cases, the lock is simple to integrate into an overall design of the control unit.

Some embodiments comprise a control unit with a magnetic lock. The control unit for an elevator installation comprises a cover and a base. The control unit further comprises a lock which can lock the cover to the base or release it from the base. The lock comprises a locking bar with a magnet, wherein this locking bar is movable back and forth from a closed position to an open position by movement of a magnetic key on a surface of the cover. In that case the locking bar with the magnet is stabilized in the closed position by a first magnetic element and the cover is locked. In the open position the locking bar is stabilized by a second magnetic element and the cover is released.

A control unit with such a magnetic lock can have the advantage that the lock is not visible externally and is therefore not at risk of vandalism. Nevertheless, such a lock is capable of securely locking a control unit. Moreover, it can be economic in production, since neither lock cylinders nor keys matching therewith have to be made. In addition, it is advantageous that such a lock can be accommodated in simple mode and manner in a design of a control unit. Thus, such a magnetic lock can, for example, be located under a company logo or at a place on the control unit without text.

The control unit comprises a cover and a base. In that case the base is fastened to a component of the elevator installation such as, for example, a cage inner wall or a shaft door post. The cover is, for example, rotatably connected with the base by way of a hinge. However, in an alternative embodiment the cover can also be completely separate from the base. The cover can consist merely of the cover surface of the control unit or, however, also include buttons or displays and/or electronic components. Equally, the base can consist only of a frame or, however, comprise buttons or displays and/or electronic components. It will be clear to the expert that the distribution of the individual components of a control unit on the cover or to the base can be undertaken in various ways.

The control unit can on the one hand, be control units for passengers such as used, for example, in elevator cages or on stories. On the other hand, control units are also used for the control of elevator installations by maintenance personnel. Such control units are located, for example, on roofs of elevator cages or in engine rooms. Moreover, the control unit can also be control units for the fire service or other bodies with special access authorization. Consequently, a control unit with such a magnetic lock can be used with versatility, wherein the above list is not exhaustive.

In an exemplary embodiment the locking bar is guided in the base in such a manner that it is secured at least in the open position and in the closed position against falling out of the base. For this purpose the locking bar can have, for example, a trapezoid-shaped cross-section along a movement direction of the locking bar, wherein a shorter base side of the trapezoid is closer to the cover than a longer base side of the trapezoid. In that case, the base of the control unit engages around the longer base side of the trapezoid and at least in part the lateral sides of the trapezoid.

In further embodiments the locking bar is guided along a movement direction, wherein a movement of the locking bar is limited by abutments to a region between the open and closed positions.

In a further embodiment a marking is arranged on a surface of the cover and indicates to a user in which regions of the surface the magnetic key can open and close the lock.

BRIEF DESCRIPTION OF THE DRAWINGS

Further details of the disclosed technologies are described in the following by way of exemplifying embodiments and with reference to the schematic drawings, in which.

DETAILED DESCRIPTION

Figure 1:
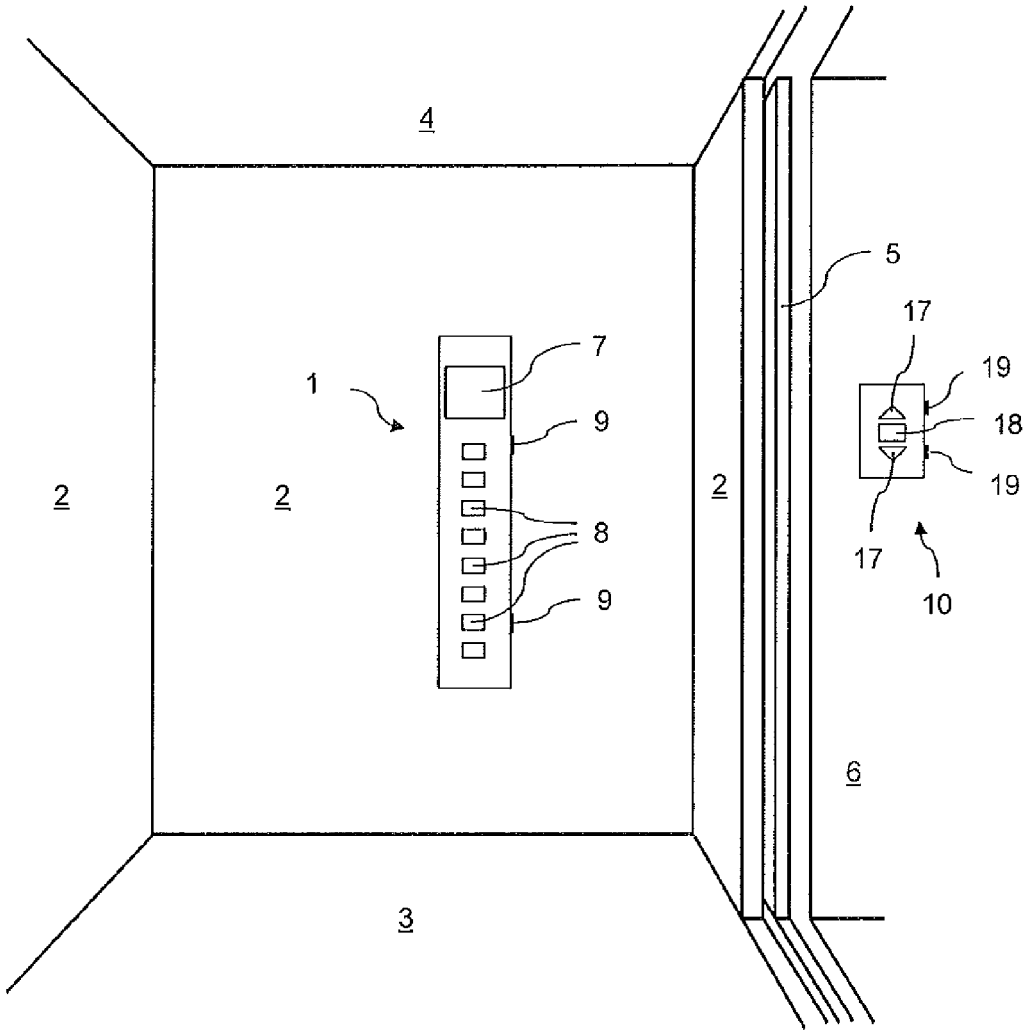
FIG. 1 shows an internal view of an exemplary elevator cage with an open cage door and a shaft opening.

An elevator cage is shown in three-dimensional illustration in FIG. 1. The elevator cage has side walls 2, a ceiling 4 and a floor 3. A cage door 5 is arranged in a side wall 2. If the elevator cage is located at a story, passengers can disembark from the cage via a shaft opening 6 when the cage door 5 is open. A shaft door (not illustrated), which can be moved synchronously with the cage door 5, is usually arranged on each story.

A cage control unit 1 is fastened to a side wall 2. The cage control unit 1 can in principle be fastened to any side wall 2. The cage control unit 1 is connected with switching and safety circuits (not illustrated) of the elevator installation.

The cage control unit 1 comprises a display 7 and buttons 8. The display 7 is suitable for the purpose of illustrating items of information for the passenger such as, for example, a designation of a story at which the elevator cage is currently located. The buttons 8 serve for, for example, the input of a destination story by the passenger or for triggering an emergency call in an emergency situation. A story control unit 10 is arranged in the shaft opening 6. The story control unit 10 similarly has a button 18 and displays 17. The button 18 is suitable for the purpose of calling an elevator cage. The displays 17 serve the purpose of indicating to a waiting passenger in which direction the arriving elevator cage is traveling.

In at least some cases, for maintenance and service operations it can be necessary to open the cage control unit 1 and/or the story control unit 10 in order to gain access to internal components. In this exemplifying embodiment the cage control unit 1 has hinges 9 arranged laterally thereof so that the cage control unit 1 can be opened without having to be separated from the cage side wall 2. Analogously thereto, the story control unit 10 has laterally arranged hinges 19 so that the story control unit 10 can be opened without having to be separated from the inner wall of the shaft opening 6.

No magnetic lock is visible in FIG. 1, because it is located under a cover of the cage control unit 1 or the story control unit 10. In the following figures the magnetic lock is explained in more detail by way of exemplifying forms of embodiment.

Figure 2:
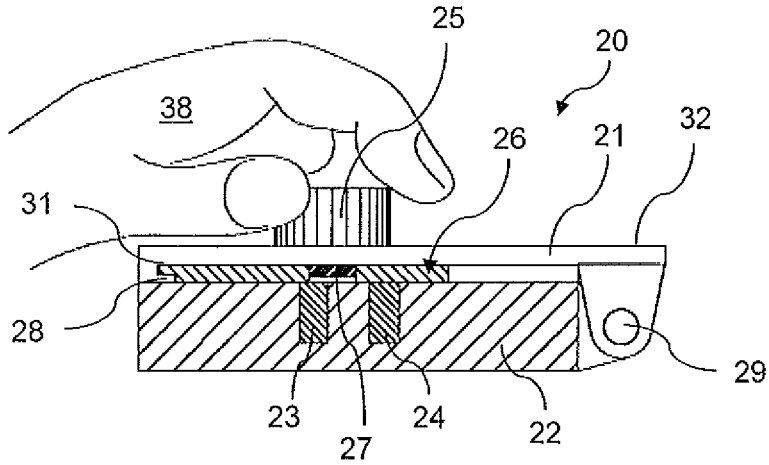
FIG. 2 shows an exemplary embodiment of a magnetic lock in its closed position in sectional illustration.
Figure 3:
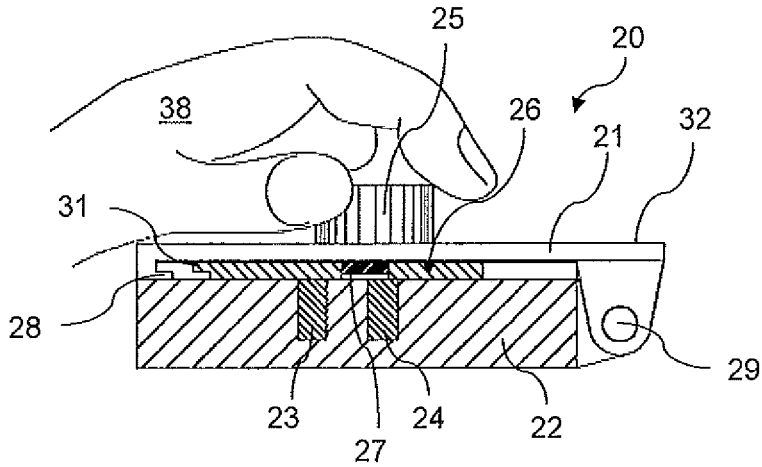
FIG. 3 shows an exemplary embodiment of a magnetic lock in its open position in sectional illustration.
Figure 4:
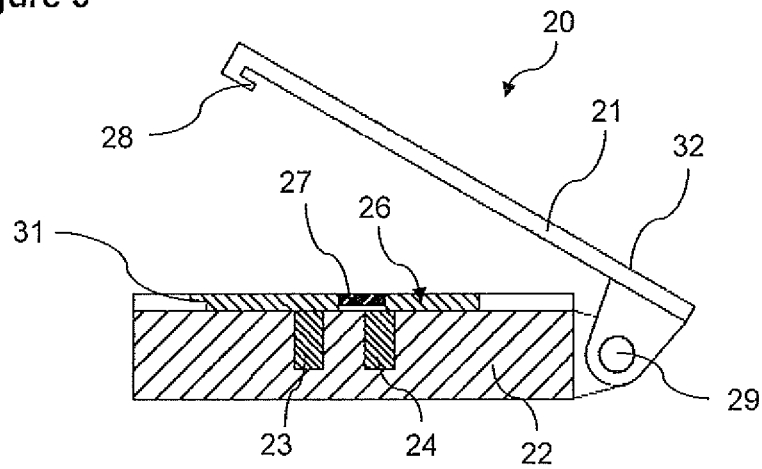
FIG. 4 shows an exemplary embodiment of a magnetic lock in opened state in sectional illustration.

An exemplifying form of embodiment of a magnetic lock is shown in sectional illustration in FIGS. 2 to 4. In FIG. 2 this magnetic lock is in a closed position. In FIG. 3 this magnetic lock is in an open position and in FIG. 4 this magnetic lock is similarly in an open position, wherein the cover, by contrast to FIG. 3, is open.

The control unit illustrated in FIGS. 2 to 4 comprises a base 22 and a cover 21. The base 22 is in that case connected by a hinge 29 with the cover 21. In these illustrations neither displays nor buttons are depicted. A first magnetic element 23 and a second magnetic element 24 are arranged in the base 22. A locking bar 26 with a magnet 27 is arranged to be displaceable by way of these magnetic elements 23, 24 with respect to the base 22. In FIG. 2 this locking bar 26 is so positioned that the magnet 27 is closer to the first magnetic element 23 than to the second magnetic element 24, wherein the locking bar 26 is stabilized in this position by the first magnetic element 23. In this position the magnetic lock is closed. In FIG. 3 the magnet 27 of the locking bar 26 is disposed closer to the second magnetic element 24 than to the first magnetic element 23, wherein the locking bar 26 is stabilized in this position by the second magnetic element 24. The magnetic lock is open in this position.

A hand of a user 38 positions a magnetic key 25 on a surface 32 of the cover 21. If the magnetic key 25 is positioned as in FIG. 2 the locking bar 26 is brought into the closed position because the magnet 27 is magnetically attracted by the magnetic key 25. If, however, the magnetic key 25 is positioned as illustrated in FIG. 3, then the locking bar 26 is disposed in the open position, because the magnet 27 is magnetically attracted by the magnetic key 25. The locking bar 26 is stabilized not only in the open position, but also in the closed position, because the respective magnetic element 23, 24 disposed closer to the magnet 27 exerts a stronger influence on the magnet 27 and thus on the locking bar 26 by virtue of a smaller spacing than the respective other magnetic element 23, 24.

In order to fix the cover 21 to the base 22 in a closed position, the locking bar 26 has a projection 31 which can engage in a hook 28 of the cover 21. In FIG. 2 this projection 31 prevents the cover from being able to be opened and in FIG. 3 the cover 21 is released by the projection 31.

The magnetic elements 23, 24 can, for example, consist of iron or material with iron content. In an alternative form of embodiment the magnetic elements 23, 24 are formed as permanent magnets. The magnetic key 25 possibly comprises a permanent magnet. Alternatively thereto the magnetic key 25 can also comprise electromagnets which are activatable, for example, by a button.

With respect to the construction of the magnetic elements 23, 24 it is, however, to be noted that the magnetic force of the magnetic key 25 should generally be of sufficient magnitude to move the lock from one position to the other position. In that case the magnetic forces or the spacings between the magnetic key 25, the magnet 27 and the magnetic elements 23, 24 can be so selected that the locking bar 26 is switched over by mere positioning of the magnetic key on the surface 32 of the cover 21. Alternatively thereto the magnetic forces can also be selected so that a displacement of the magnetic key 25 on the surface 32 of the cover 21 is necessary in order to switch over the locking bar 26.

It is evident that the design of the magnetic components 23, 24, 25, 27 can be carried out in numerous ways in order to ensure the characteristics described here. The forms of embodiment expressed here are therefore to be understood merely as examples deriving from a multiplicity of possible alternatives.

Figure 5:
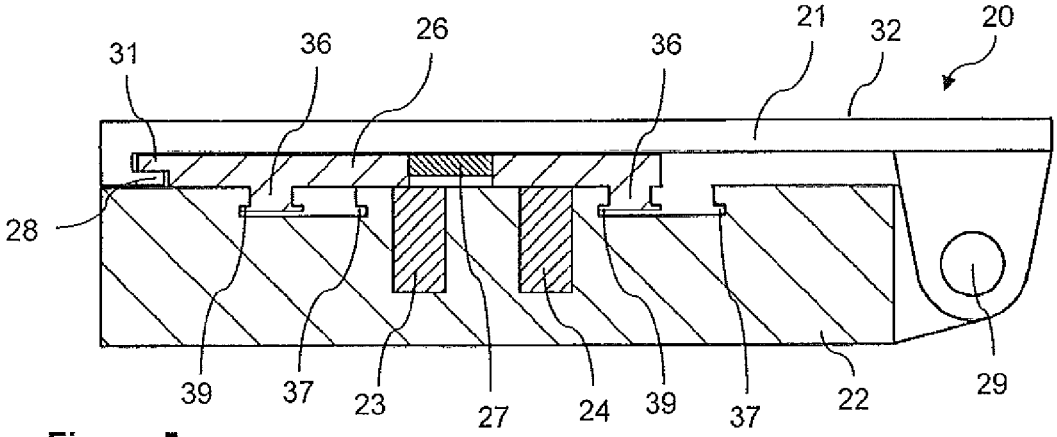
FIG. 5 shows an exemplary embodiment of a magnetic lock in closed state in sectional illustration.

An alternative form of embodiment of a control unit 20 is illustrated in FIG. 5. A cover 21 is again rotatably connected with a base 22 by way of a hinge 29. By contrast to the exemplifying embodiment illustrated in FIGS. 2 to 4, in this exemplifying embodiment the locking bar 26 has engagement elements which can respectively engage in a first groove 39 and a second groove 37. In the illustrated closed position the engagement elements are disposed in the respective first grooves 39. If the locking bar 26 is now moved by a magnetic key into the open position then the engagement elements 36 are respectively disposed in the second 30 grooves 37. Thanks to the engagement elements the locking bar 26 is protected not only in the closed position, but also in the open position from falling out of the base 22.

Figure 6:
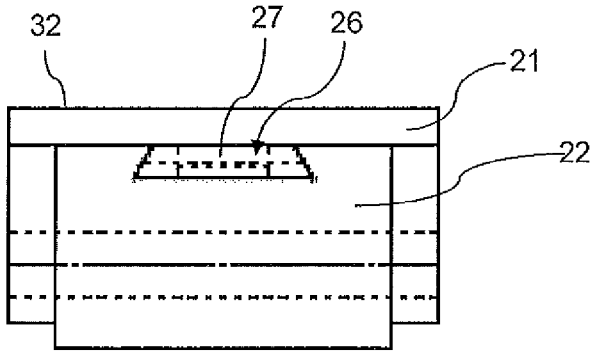
FIG. 6 shows an exemplary embodiment of a magnetic lock illustrated in cross-section.

An alternative mechanism for securing the locking bar 26 against falling out of the base 22 is illustrated in FIG. 6. In this cross-sectional illustration a movement direction of the locking bar 26 is located perpendicularly to the illustration surface. The locking bar 26 has in this exemplifying embodiment a trapezoid-shaped cross-section. In that case the shorter base side of the trapezoid is closer to the cover 21 than the longer base side of the trapezoid. By virtue of the inclined lateral sides of the trapezoid, which are retained by a corresponding recess in the base 22, the locking bar 26 is protected against dropping out of the base 22 when the cover 21 is open.

Figure 7:
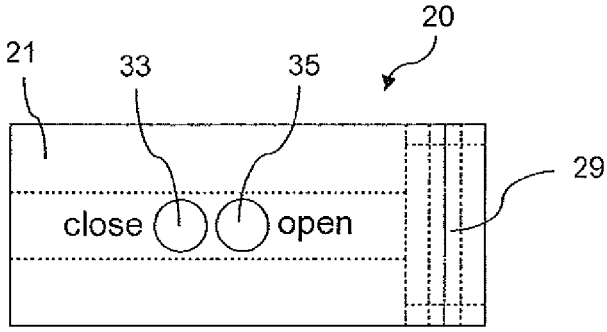
FIG. 7 shows an exemplary embodiment of a magnetic lock under a cover in plan view.
Figure 8:
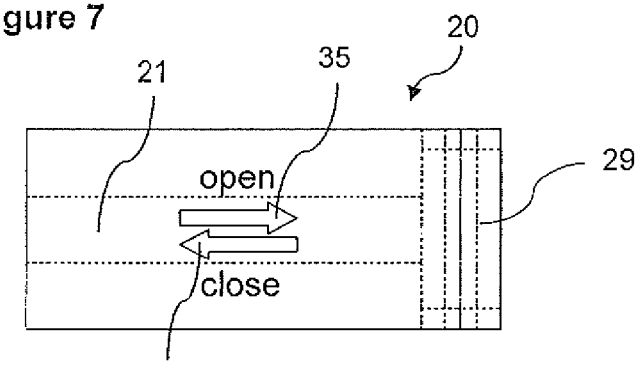
FIG. 8 shows an exemplary embodiment of a magnetic lock under a cover in plan view.

Two exemplifying embodiments of a detail of a control unit 20 are illustrated in plan view in FIGS. 7 and 8. In that case only the cover 21 is visible in each instance. The hinge 29 is illustrated by a dotted line. A movement space of the locking bar in the base is similarly illustrated by a dotted line. Respective markings 33, 35 are applied to the cover 21. These show to a user how the magnetic key can be held or placed on the cover 21 in order to open and close the lock.

In FIG. 7 these markings 33, 35 consist of two circles, wherein placed near a first circle is the designation 'close' and near a second circle the designation 'open'. If the magnetic key is now held on one of these markings 33, 35 in circular form, then the lock opens or closes. The circular form can correspond with a plan area of the magnetic key. It will be obvious that other forms such as rectangles, triangles or irregular shapes can also be used instead of circles.

In FIG. 8 the marking consists of two arrows 33, 35 and respectively associated designations 'open' and 'close'. If the magnetic key is now moved in arrow direction over the markings 33, 35 then the magnetic lock opens and closes.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. I therefore claim as my invention all that comes within the scope and spirit of these claims.

I claim:

1. An elevator installation control unit, comprising:

a cover;

a base;

a lock coupled to the base, the lock being configured to lock the cover to the base, the lock comprising a locking bar with a magnet, the locking bar being movable between open and closed positions in response to a movement of a magnetic key on a surface of the cover, a first magnetic element being configured to stabilize the locking bar in the closed position to lock the cover, a second magnetic element being configured to stabilize the locking bar in the open position to release the cover.

2. The elevator installation control unit of claim 1, at least a portion of the locking bar being movable within the base.

3. The elevator installation control unit of claim 1, the locking bar being movably secured to the base.

4. The elevator installation control unit of claim 1, at least a portion of the locking bar being movable within the base, movement of the locking bar relative to the base being limited by abutments on the base.

5. The elevator installation control unit of claim 1, the locking bar comprising an elongated member having a trapezoidal cross-section.

6. The elevator installation control unit of claim 5, the elongated member comprising a wide elongated surface and a narrow elongated surface, the wide elongated surface facing the base and the narrow elongated surface facing the cover.

7. The elevator installation control unit of claim 6, the base comprising a recess for receiving at least a portion of the locking bar and at least partially enclosing the locking bar.

8. The elevator installation control unit of claim 1, the locking bar comprising a projection configured to engage a hook of the cover.

9. The elevator installation control unit of claim 1, the cover comprising one or more markings indicating one or more magnet key placement regions on the cover.

10. The elevator installation control unit of claim 1, the control unit being a cage control unit.

11. The elevator installation control unit of claim 1, the control unit being a story control unit.

12. The elevator installation control unit of claim 1, the cover being rotatably coupled to the base by at least one hinge.

13. The elevator installation control unit of claim 1, the locking bar comprising at least one engagement element, the at least one engagement element being configured to engage a first groove of the base when the locking bar is in the open position and to engage a second groove of the base when the locking bar is in the closed position.

14. An elevator installation, comprising:

an elevator car disposed in an elevator shaft; and a control unit coupled to the elevator car, the control unit comprising, a cover, a base, and a lock coupled to the base, the lock being configured to lock the cover to the base, the lock comprising a locking bar with a magnet, the locking bar being movable between open and closed positions in response to a movement of a magnetic key on a surface of the cover, a first magnetic element being configured to stabilize the locking bar in the closed position to lock the cover, a second magnetic element being configured to stabilize the locking bar in the open position to release the cover.

15. An elevator component lock, comprising:

a cover;

a base; and a locking bar, the locking bar comprising at least one magnet and being movable between first and second positions in response to a magnetic key positioned near the cover, the locking bar being biased toward the first position by a first magnet in the base and biased toward the second position by a second magnet in the base.

* * * * *